US005613677A

United States Patent [19]

Walker, Jr.

[11] Patent Number: 5,613,677

[45] Date of Patent: Mar. 25, 1997

[54] BASEBALL BATTING TRAINING DEVICE

[76] Inventor: Wallace L. Walker, Jr., 2230 Escalera Way, Reno, Nev. 89523

[21] Appl. No.: 96,782

[22] Filed: Jul. 23, 1993

[51] Int. Cl.[6] ..... A63B 71/02

[52] U.S. Cl. ..... 473/452

[58] Field of Search ..... 273/26 R, 188 A, 273/32 C, 29 A, 187 R, 55 R, 187.12, 189 A, 188, 187.2, 193 B; 482/79, 80, 100

[56] References Cited

U.S. PATENT DOCUMENTS

| | | | |
|---|---|---|---|
| 2,558,081 | 6/1951 | Gardenhour | 273/55 R |
| 2,713,487 | 7/1955 | Jaediker | 273/55 R |
| 2,934,343 | 4/1960 | Schumacher | 273/55 R |
| 2,967,709 | 1/1961 | Stahley | 273/55 R |
| 3,377,064 | 4/1968 | Hudson et al. | 273/55 R |
| 3,994,501 | 11/1976 | O'Donnell | 273/187 R |
| 4,516,772 | 5/1985 | Stratton | 273/188 A |

*Primary Examiner*—Theatrice Brown
*Attorney, Agent, or Firm*—Bernhard Kreten

[57] ABSTRACT

A batter training device (10) is provided for training a batter (B) to effectively strike a baseball by controlling the batter's stance. The device (10) is positioned on the ground (G) in front of a leading foot (F) of the batter (B). During the batter's swing, the batter (B) steps forward with the leading foot (F) until the leading foot (F) strikes the device (10). The device (10) includes a rear plate (40) fixed to the ground (G) and a forward plate (20) hingedly attached to the rear plate (40). A spring (99) is oriented between the front plate (20) and the rear plate (40). The device (10) is oriented so that the front plate (20) will be located adjacent to a final destination for the leading foot (F) when the front plate (20) has been pivoted towards the rear plate (40) and against maximum spring (99) compression. The spring (99) is selected to exert sufficient force between the rear plate (40) and the front plate (20) so that the batter (B) must stride forcefully into the front plate (20). The batter (B) is thus trained to move the leading foot (F) forcefully forward and to orient the leading foot properly when planting the foot during swinging at the baseball. Thus, the device, when properly located, prevents the batter's leading foot (F) from unwanted pivoting both with respect to the device (10) and during game conditions.

13 Claims, 3 Drawing Sheets

BASEBALL BATTING TRAINING DEVICE

FIELD OF THE INVENTION

The following invention relates to devices for training baseball players in the skill of batting. More specifically, this invention relates to devices for educating a baseball player in proper foot and lower body action while batting.

BACKGROUND OF THE INVENTION

Few endeavors in the field of athletics are as complex and difficult to master as effectively hitting a baseball. The cylindrical bat and small ball make effective hitting difficult. Furthermore the ball is delivered at high speed by a pitcher with the express intention of getting the ball past the batter without the ball being struck. As a result, even those highly proficient in the skill of batting rarely can effectively strike the ball, placing it in play, more often than one out of every three attempts. As a result, numerous devices and training techniques have been developed to improve the batting skills of baseball players. This attention to the skill of batting has resulted in the discovery that if the batter strides forcefully in a direction parallel to and toward the oncoming pitched ball, the bat can be swung more forcefully, thereby hitting the ball with more power. This striding technique further complicates the batting process.

While there is some dispute as to the best way to stride when striking the ball, as is evidenced by the variety of stances and batting motions of successful major league baseball players, general agreement exists as to certain fundamentals which should be followed for effective batting. These fundamentals include that the batter should stride parallel to the path of the ball and toward the pitcher's mound. Also, the batter should stride forward as forcefully as possible to effect a weight shift from the back foot to the front foot toward the pitcher's mound. While striding, the batter should keep the front foot oriented perpendicular to the path of the pitched baseball, so that toe of the foot does not pivot towards the pitcher's mound, causing the batter's knee and hip to improperly "open up" to face the pitcher.

These fundamentals, while easily discussed in theory are difficult to master while practicing with actual live pitching. Accordingly, a need exists for devices which train baseball players in these fundamental techniques so that with repetition, the batter can learn proper batting technique.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| David, D. J. | 3,342,487 | September 19, 1967 |
| Kile, S. E. et al | 3,350,096 | October 31, 1967 |
| Hermo, L. E. | 3,815,906 | June 11, 1974 |
| Kiray, J. D. | 4,225,133 | September 30, 1980 |
| Tetreault, A. G. | 4,664,375 | May 12, 1987 |
| Johnson, E. O. | 5,037,094 | August 6, 1991 |
| Lang, J. D. | 5,076,580 | December 31, 1991 |

The patent to David teaches the use of a baseball stance and stride practice plate which has a fixed board which the batter stands upon and utilizes while practicing with pitched baseballs. This invention is distinguishable from David in that this invention includes a plate which can move from a first position to a second position while applying force against the leading foot of the batter. The batter thus learns not only proper foot positioning but also the proper force to be applied when striding forward toward the pitcher's mound.

The patent to Kile teaches the use of a batter's front-foot guide that includes a plurality of cords fastened to the front foot of the batter and connected to the ground through springs. This invention is distinguishable from the teachings of Kile in that this invention does not require attachment to the foot of the batter, but rather stands separate from the front foot of the batter until the batter strikes the device during the swinging motion. Also, the device of this invention can be utilized to prevent the front foot of the batter from rotating, causing the batter's stance to open up.

The remainder of the prior art diverge even more starkly from this invention than do the devices specifically distinguished above.

SUMMARY OF THE INVENTION

This invention includes two plates which pivot with respect to each other. A rear plate is fixed to the ground and a front plate is pivotably connected to the rear plate at a first end thereof through a hinge. A second end of the front plate opposite the hinge has a spring adjacent thereto which is interposed between the front plate and the rear plate. The hinge allows the front plate to pivot toward the rear plate while the spring requires that a force be applied to cause the front plate to travel toward the rear plate.

The spring is supported along an alignment bolt which is threaded to a yoke on one end which pivotably attaches to a tab affixed to a back surface of the front plate. An end of the alignment bolt opposite the yoke has a head thereon. The rear plate has a hole large enough to receive the alignment bolt therethrough but smaller than the head of the bolt. Thus, the front plate is prevented from pivoting away from the rear plate a distance greater than a length from the head of the alignment bolt to the yoke attached to the alignment bolt.

The rear plate includes spike sleeves on a rear side thereof which can receive spikes therethrough. The spikes can either be pointed for driving into the ground or can have threaded ends and can be oriented passing through the spike sleeves and through a board beneath the device. The device can then be fastened to the board with nuts, such as wing nuts. By attaching the device to a board, the device can be used on surfaces in which spikes cannot be driven.

The batter stands with a front foot closer to the front plate than a rear foot. The front foot is oriented with a toe thereof closest to the second end of the front plate and a heel located closest to the first end of the front plate. As the batter swings, the batter moves the front foot to impact a front surface of the front plate causing the front plate to be moved toward the rear plate. The front plate is large enough to prevent the front foot of the batter from pivoting and the spring is selected to require sufficient force to be collapsed that the batter must step forcefully into the front surface of the front plate. This requires the batter to step forcefully forward while also preventing hips of the batter from sliding forward.

OBJECTS OF THE INVENTION

Accordingly, it is a primary object of the present invention to provide a device which is utilizable in training a batter while the batter simultaneously swings at a baseball.

Another further object of the present invention is to provide a device which instructs the batter in the proper movement of the feet of the batter during swinging.

Another further object of the present invention is to provide a device which trains a batter to stride forward while batting with a closed front foot.

Another further object of the present invention is to provide a device which allows a batter to get a good back turn during the swinging process.

Another further object of the present invention is to provide a device which prevents hips of the batter from sliding forward during the swinging motion.

Another further object of the present invention is to provide a device which is adjustable to accommodate batters with different stride lengths and which swing from both left and right sides of the plate.

Another further object of the present invention is to provide a device which keeps batters from getting too far forward during the swinging process.

Another further object of the present invention is to provide a device which is of simple construction and is durable and easy to manufacture.

Another further object of the present invention is to provide a device which can be utilized in training baseball players to bat while standing on either an artificial surface or a natural surface.

Viewed from a first vantage point it is an object of the present invention to provide a baseball batting training device, comprising in combination, a contact surface adapted to be impacted by a foot of a batter, means to allow movement of the contact surface from a beginning position to an ending position, and means for resisting movement of the contact surface from the beginning position to the ending position operatively coupled to the contact surface.

Viewed from a second vantage point it is an object of the present invention to provide a device for resisting movement of a foot of a baseball batter, the device training a batter to exert more force when moving a front foot from a first pre-pitch position to a second post-pitch position, the device comprising: a contact surface interposed between the pre-pitch position and the post-pitch position, a means to absorb the force applied to the contact surface by the front foot of the batter, the absorption means including means to allow movement of the contact surface from the pre-pitch position to the post-pitch position when impacted by the front foot of the batter with a sufficient force.

Viewed from a third vantage point it is an object of the present invention to provide a method for controlling motion of a leading foot of an athlete who strides from a first position to a second position to more effectively strike a projectile moving past the athlete, including the steps of orienting a barrier within a path between the first position and the second position, and allowing programmed resistance to movement of the barrier.

These and other objects will be made manifest when considering the following detailed specification when taken in conjunction with the appended drawing figures.

DESCRIPTION OF PREFERRED EMBODIMENTS

Figure 1:
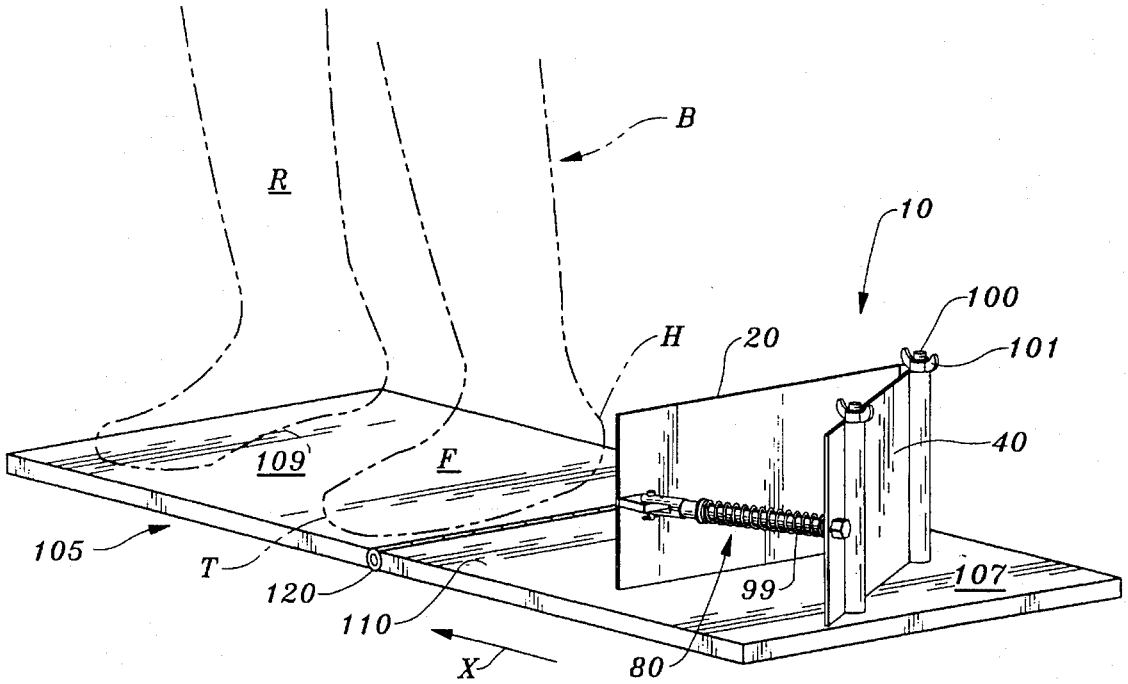
FIG. 1 is a perspective view of the device of this invention being utilized by a batter before a ball is pitched.

Referring to the drawings, wherein like reference numerals represent like parts throughout the various drawing figures, reference numeral 10 is directed to a baseball batting training device (FIG. 1). The device 10 is utilized by a batter B to discipline the batter B to move a front foot F in a fundamentally correct manner while swinging at a baseball with a bat.

Figure 2:
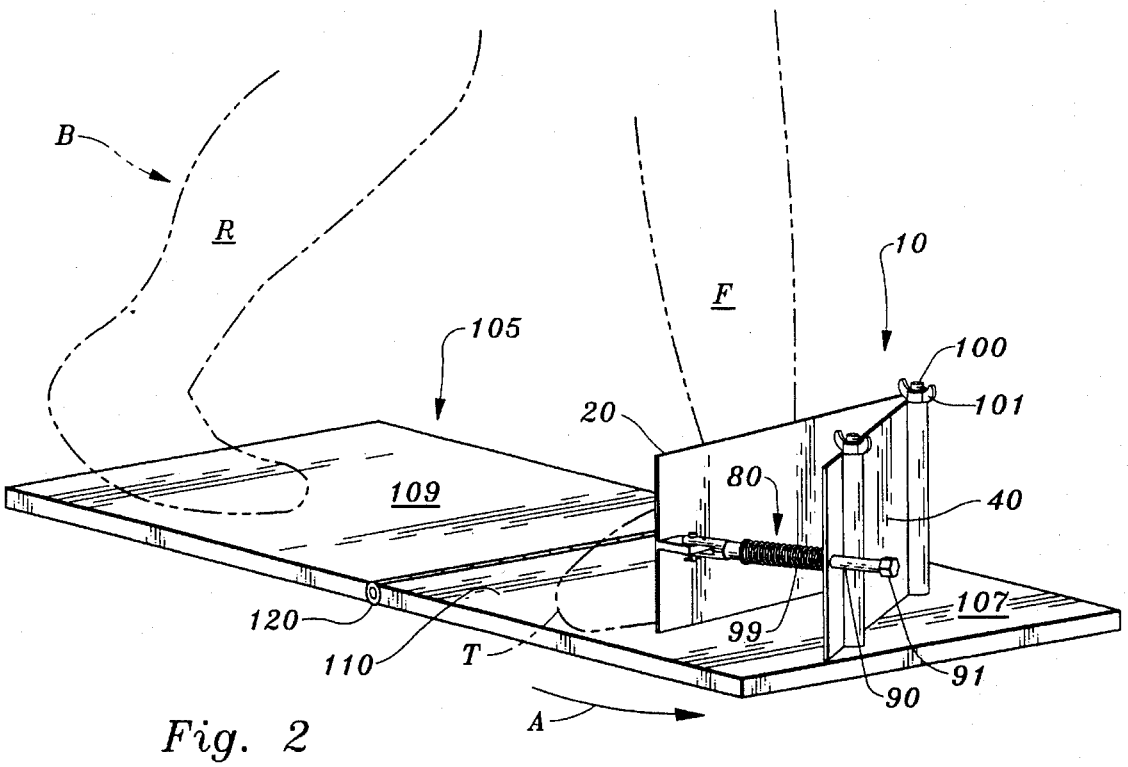
FIG. 2 is a perspective view of that which is shown in FIG. 1 after its utilization by a batter while swinging at a pitched ball.
Figure 3:
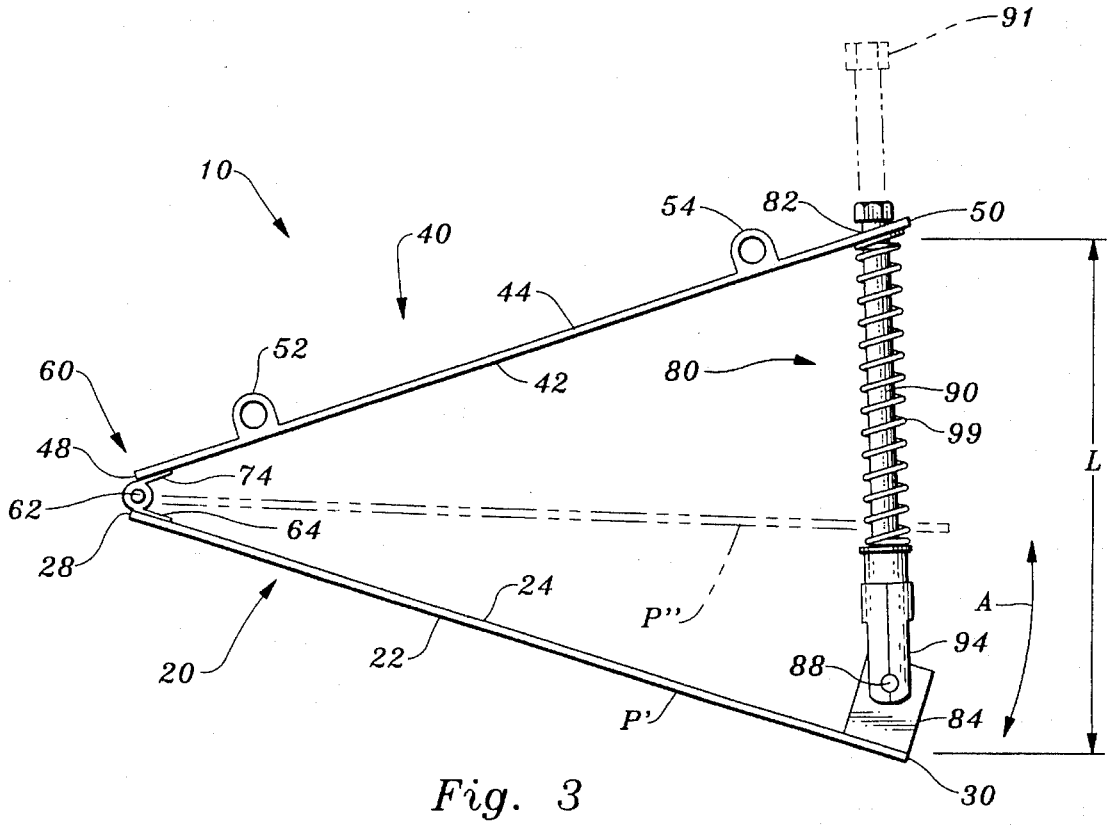
FIG. 3 is a top view of that which is shown in FIG. 1.

In essence, and referring to FIGS. 1 and 2, the device 10 includes a front plate 20 attached to a rear plate 40 through a hinge 60 (FIG. 3). The hinge 60 connects a first end 28 of the front plate 20 to a first end 48 of the rear plate 40. A spring 99 is interposed between a second end 30 of the front plate 20 and a second end 50 of the rear plate 40. The rear plate 40 has a first spike sleeve 52 and a second spike sleeve 54 on a rear side 44 (FIG. 3) of the rear plate 40. Each spike sleeve 52, 54 receives a grounding bolt 100 which attaches the rear plate 40 to a board 105. The board 105 underlies the device 10 at a forward region 107 and extends back to a rear region 109 which underlies a rear foot R of the batter B. The batter B strides from the rear region 109 to the front region 107 with the front foot F, impacting the front plate 20 and causing the front plate 20 to pivot (along arrow A) about the hinge 60 and compressing the spring 99.

Figure 5:
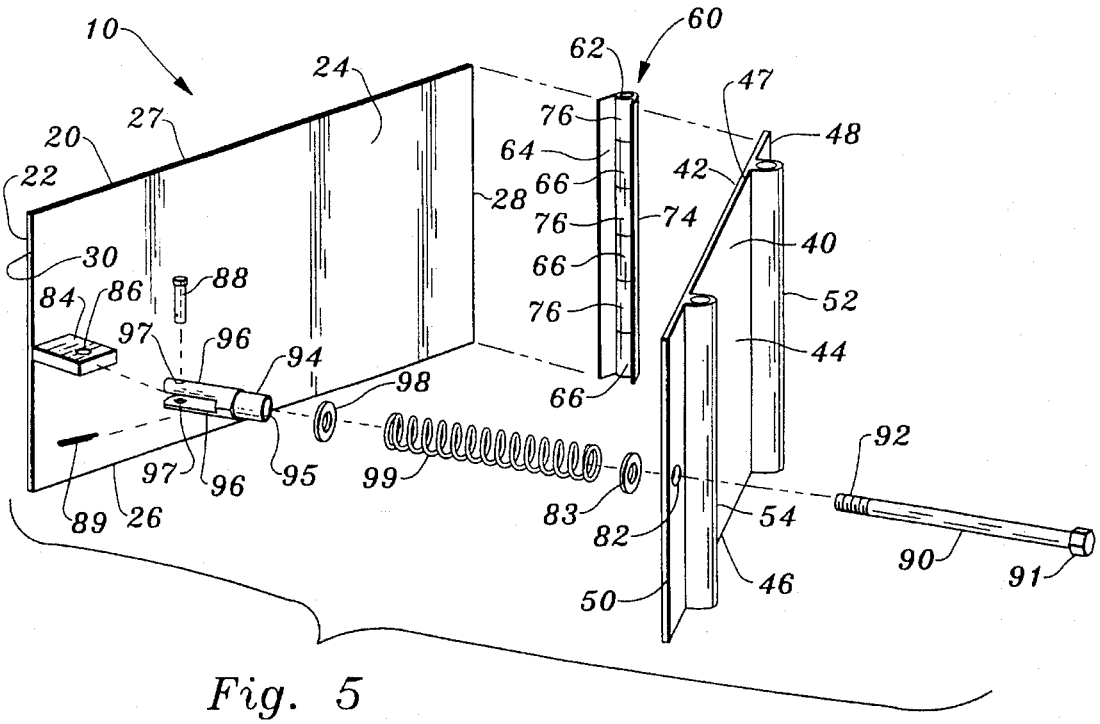
FIG. 5 is an exploded parts view of that which is shown in FIG. 1.

More specifically, and referring in detail to FIG. 5, the training device 10 exhibits the following structure. The front plate 20 is a substantially planar rectangular construct having a front surface 22 and a back surface 24. The front surface 22 is oriented to face the front foot F of the batter B, acting as a contact surface and a barrier for opposing motion of the front foot F. The front plate 20 includes the first end 28 closest to the hinge 60 and the second end 30 opposite the first end 28. The training device 10 is oriented so that the first end 28 of the front plate 20 is preferably adjacent a heel H of the batter B (FIG. 1) and the second end 30 is located adjacent a toe T of the batter B.

FIGS. 1 through 6 show the device as it would be oriented for a right-handed batter. Note however, that the training device 10 can be inverted 180° for use with a left-handed batter B. In both cases, the first end 28 would still be adjacent the hinge 60 and adjacent the heel H of the batter B. The front plate includes a bottom edge 26 oriented adjacent a top surface 110 of the board 105 which underlies the training device 10. A top edge 27 defines an edge opposite the bottom edge 26. When the training device 10 is inverted for a left-handed batter, the top edge 26 and bottom edge 26 are reversed in orientation.

The rear plate 40 is a substantially planar rectangular construct having a front side 42 (FIG. 4) parallel to a rear side 44. The front side 42 is oriented on a side of the rear plate 40 closest to the front plate 20. The rear side 44 is oriented on a side of the rear plate 40 opposite the front side 42. The rear plate 40 includes the first end 48 adjacent the hinge 60 and the second end 50 adjacent the spring 99. The rear plate 40 includes a lower edge 46 oriented adjacent the board 105 and an upper edge 47 opposite the lower edge 46.

As noted above, when the training device 10 is utilized by a left-handed batter, the lower edge 46 and upper edge 47 are reversed.

The rear side 44 of the rear plate 40 includes a first spike sleeve 52 and a second spike sleeve 154 adhered thereon. Both of the spike sleeves 152, 154 are oriented with a central bore extending vertically parallel to the axis of rotation about the hinge 60. The spike sleeves 52, 154 are sized to receive grounding bolts 100 therethrough. Grounding bolts 100 attach on one end to the board 105 and on a second end extend through and above the spike sleeves 52, 54 where wing nuts 101 are preferably used to fasten the spike sleeves 52, 54, and hence the training device 10, to the board 105. The rear plate 40, board 105, and grounding bolts 100 act as one version of a means to interface with a ground surface and support the device 10.

A height of the front plate 20 between the bottom edge 26 and the top edge 27 is preferably slightly less than a height of the rear plate 40 between the lower edge 46 and the upper edge 47. The front plate 20 is preferably centered with respect to the rear plate 40. Thus, the bottom edge 26 is preferably slightly higher than the lower edge 46 and top edge 27 is preferably slightly lower than the upper edge 47. With these dimensions and orientation, the front plate 20 exhibits clearance above the board 105 when the lower edge 46 of the rear plate 40 is adjacent a top surface 110 of the board 105. Thus, the front plate 20 is prevented from pinching against the top surface 110 of the board 105 when moving along arrow A (FIG. 2). The top edge 27 is slightly lower than the upper edge 47 so that when the training device 10 is reversed for use by a left-handed batter, the top edge 27 of the front plate 20 is held above the top surface 110 of the board 105. Thus the front plate 20 is cantilevered from the rear plate 40.

The hinge 60 includes a forward leaf 64 fixedly attached to the first end 28 of the front plate 20 (preferably with a weld) and a rearward leaf 74 fixedly attached to the first end 48 of the rear plate 40 (preferably with a weld). The forward leaf 64 is oriented on the back surface 24 of the front plate 20 and the rearward leaf 74 is located on the front side 42 of the rear plate 40. The forward leaf 64 has knuckles 66 and the rearward leaf 74 has knuckles 76. The knuckles 66 and knuckles 76 are oriented in a pattern which allows the knuckles 66, 76 to interleave about a common vertical axis. A pintle 62 is oriented through the knuckles 66, 76 holding the forward leaf 64 and rearward leaf 74 together. The hinge 60 thus provides one form of a means to allow movement of the front plate 20 with respect to the rear plate 40.

The spring 99 preferably forms one component of a motion resistance means 80 of the training device 10. Alternative motion resistance means 80 could include other elastic energy storage devices or damping devices such as shock absorbers. The motion resistance means 80 includes a tab 84 fixedly attached to and extending from the back surface 24 of the front plate 20. The tab 84 includes a tab hole 86 passing therethrough. A yoke 94 includes two legs 96 with leg holes 97 therein which are oriented to straddle the tab hole 86 along a common axis. A pin 88 passes through the tab hole 86 and leg holes 97 of the yoke 94 holding the legs 96 of the yoke 94 adjacent to the tab 84 in pivotable relationship. A pin retainer 89 preferably prevents the pin 88 from translating axially out of the tab hole 86 and the leg holes 97.

The yoke 94 includes a threaded hole 95. An alignment bolt 90 has a threaded tip 92 sized to be threaded into the threaded hole 95 of the yoke 94. An end of the alignment bolt 90 opposite the threaded tip 92 includes a head 91 thereon. A hole 82 passes through the rear plate 40 at the second end 50. The alignment bolt 90 passes through the hole 82 with the bolt head 91 on the rear side 44 of the rear plate 40. The threaded tip 92 extends through the hole 82 to the front side 42 of the rear plate 40 and is threaded into the threaded hole 95 of the yoke 94.

Figure 4:
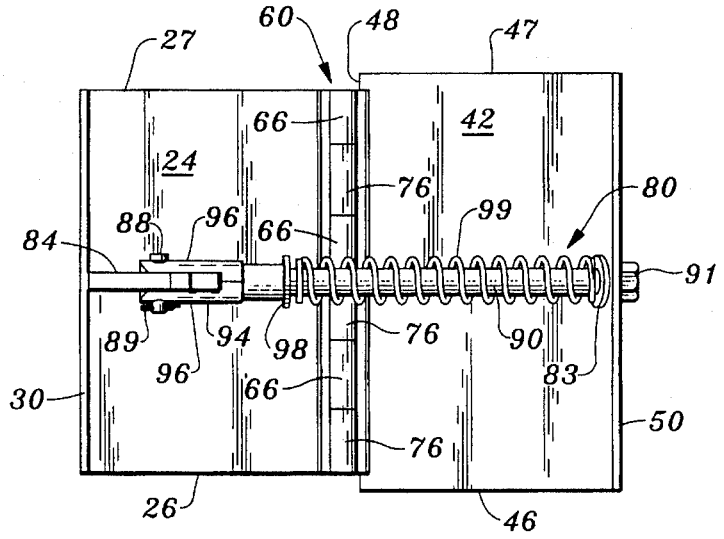
FIG. 4 is a side view of that which is shown in FIG. 1.

A washer 98 surrounds the alignment bolt 90 adjacent the yoke 94. The spring 99 surrounds the alignment bolt 90 such that the alignment bolt 90 extends along a long axis of the spring 99. The spring 99 is sandwiched between the washer 98 and rear plate 40. The spring 99 is selected to have a inner diameter greater than a diameter of the alignment bolt 90 and an outer diameter less than a diameter of the washer 98 and greater than a diameter of the hole 82. The spring 99 is also selected to exert a desired force, and is thus programmed to resist the batter B an appropriate amount. The hole 82 can also have a washer 83 adjacent thereto, adjacent the front side 42 of the rear plate 40 as shown in FIG. 4. Thus, the spring 99 is bounded between the washer 98 adjacent the yoke 94 on a first end and the washer 83 adjacent the hole 82 on a second end.

When the front plate 20 is pivoted about a vertical axis and about the hinge 60 toward the rear plate 40, the alignment bolt 90 is forced through the hole 82 while the yoke 94 pivots slightly with respect to the tab 84. The yoke 94 causes the washer 98 to impact and compress the spring 99. The spring 99 thus applies a force against the front plate 20 resisting motion of the front plate 20 toward the rear plate 40. While the spring 99 is compressed, the alignment bolt 90 telescopes out through the hole 82 in the rear plate 40. As an assembly, the motion resistance means 80 provides a means to transfer work done by the batter B into potential energy. This potential energy is utilized when the front foot F is removed, causing the front plate 20 to return to its original position.

As shown in detail in FIG. 3, the front plate 20 moves in an arc, along arrow A, as the spring 99 is compressed. The front plate 20 thus has a beginning position P' before being impacted by the front foot F of the batter B, and an ending position P" after the front plate 20 has been impacted by the batter B. The second P" position is preferably selected to have a location and orientation which is desired for the batter B to have at the end of the swinging movement. Thus, the batter B is required to impact the front surface 22, which defines a contact surface with the batter's front foot F with sufficient force to compress the front plate 20 to the second position P" in order to locate the batter's front foot F at the desired location. When fully compressed, the front plate 20 is spaced from the rear plate 40 a distance similar to a minimum compressed length L of the spring 99 and associated components of the motion resistance means 80. This required force thus causes the batter B to effectively shift the batter's weight in a sufficiently forceful manner.

Note that the orientation of the front plate 20 requires that the toe T of the front foot F of the batter B remain pointed substantially parallel to the front plate 20, This prevents the front foot F of the batter B from pivoting and causing the batter B to "open up" his stance by pointing the toe T toward a pitcher's mound. When the toe T of the front foot F is held parallel to the front plate 20, hips of the batter B are kept from pivoting during the first portion of the swinging process. This control of a batter's front foot F, legs and hips has been shown to result in superior results in striking the ball. In essence the device holds the front foot substantially perpendicular to the direction of ball travel.

Figure 6:
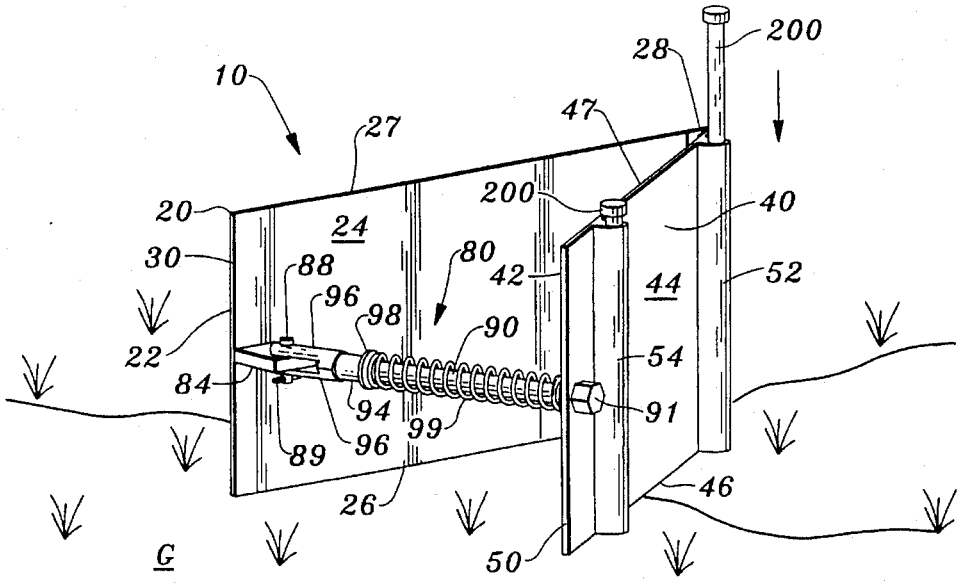
FIG. 6 is a perspective view of an alternative embodiment of the device of this invention which allows this invention to be used on a natural surface.

In an alternative embodiment, shown in FIG. 6, the training device 10 can be utilized on the ground G without the board 105. Spikes 200 are utilized in place of the grounding bolt 100 which pass through the spike sleeves 52, 54. The spikes 200 are sized with a length sufficient to be driven into the ground G a distance which ensures that the rear plate 40 will not pivot when the front plate 20 is struck by the front foot F of the batter B. The device 10 can then be used on a natural surface such as the dirt within a batter's box on a baseball field.

In use and operation, and referring to FIGS. 1 and 2, the batter B initially stands in a pre-pitch position on the rear region 109 of the top surface 110 of the board 105 with both a front foot F and rear foot R. The training device 10 is located over the front region 107 of the top surface 110 of the board 105. When a ball is pitched and on its way along a path parallel to arrow X of FIG. 1 and close to the batter B, the batter B strides forward with the front foot F causing the front foot F to impact the front surface 22 of the front plate 20. The front plate 20 is then pivoted, along arrow A (FIG. 2), toward the rear plate 40. The motion resistance means 80 resists motion of the front plate 20 toward the rear plate 40.

As the batter B applies sufficient force to the front plate 20 to cause the front plate 20 to approach the rear plate 40, the batter's front foot F is held with the toe T and heel H disposed along a line which is substantially parallel to the front plate 20. The batter B then plants the front foot F in a post-pitch position and swings at the ball. The device 10 encourages the batter B to keep the hips back from the direction of the pitched ball. This improves the swinging motion. As contact is made with the ball, the batter's rear foot R may be pivoted (as shown in FIG. 2) in a "back turn" which may add power to the swinging motion.

The training device 10 prevents the front foot F from pivoting which would cause the front foot F to "open up". When a batter's front foot F opens up, the toe T and heel H become oriented along a line which begins to approach the location from which the ball was pitched. When this occurs, the batter B will tend to also point a knee above the front foot F toward the source of the pitched ball along with the hips, shoulders and head. This pivoting decreases the effectiveness of the swinging action.

When the training device 10 is to be stored, the board 105 can be pivoted about a hinge 120 causing the front region 107 and the rear region 109 to be oriented adjacent each other. The training device 10 can be removed from the board 105 and the alignment bolt 90 can be threaded out of the threaded hole 95 of the yoke 94 allowing the front plate 20 and rear plate 40 to be folded into close proximity with each other. The training device 10 and the board 105 can then be easily collapsed and stored or packaged for transport.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A baseball batting training device comprising in combination:

a contact surface adapted to be impacted by a properly moved foot of a batter as a batter strides from a beginning position to an ending position, means to allow movement of said contact surface from said beginning position to said ending position, means for resisting motion of said contact surface from said beginning position to said ending position operatively coupled to said contact surface, wherein said resisting means includes an elongate spring having a long central axis and which transfers work done by the foot of the batter against said contact surface while changing his stride and therefore resisting moving of said contact surface from said beginning position to said ending position and into potential energy sufficient to maintain a force which resists movement of said contact surface with the force sufficient to return said contact surface from the ending position to the beginning position when the foot of the batter is displaced from said contact surface, wherein said resisting means includes a tab fixedly attached to said contact surface, a yoke pivotably attached by pivot means to the tab, and an alignment bolt connected to said yoke, extending along said long central axis of said spring and supported at a rear plate, whereby said alignment bolt maintains said spring between said contact surface and said rear plate, wherein said contact surface is a rigid planar front plate with a bottom edge from which vertically extends a front surface facing the foot of the batter, and wherein said rear plate has a lower edge and said rear plate is oriented in a plane which extends substantially vertically upward from said lower edge, said rear plate including a plurality of sleeves attached thereto to receive spikes passing through said sleeves for support on a support surface.

2. The device of claim 1 wherein said pivot means is a hinge interposed between said front plate and said rear plate, said hinge including a forward leaf fixedly attached to an end of said front plate and a rearward leaf fixedly attached to an end of said rear plate.

3. The device of claim 1 wherein said bottom edge of said front plate is positioned higher than said lower edge of said rear plate, whereby when said front plate pivots toward said rear plate, said bottom edge is spaced slightly from a said support surface to prevent engagement therewith preventing said bottom edge from impacting the ground.

4. The device of claim 1 wherein said support surface is a horizontally oriented planar board placed below said front and rear plates, said board having a forward portion with said spikes attached thereto and a rearward portion supporting a rear foot of the batter, whereby said device can be utilized on surfaces without driving said spikes directly into the ground.

5. The device of claim 4 wherein said forward portion of said board and said rearward portion of said board are connected together by a hinge, said hinge allowing said board to be folded over until the longest dimension of said board is reduced in half, whereby said device can be more easily transported and stored in small spaces.

6. A device for resisting movement of a foot of a baseball batter, the device training a batter to exert more force with this front foot when said front foot is properly moved from a first beginning pre-pitch position to a second ending post-pitch position during a hitting stride, the device comprising in combination:

a contact surface, a means to absorb the force applied to said contact surface by the front foot of the batter, said absorption means including means to allow movement of the contact surface from beginning position to said ending position when impacted by the front foot of the batter with a sufficient force, wherein said force absorption means is a spring interposed between said contact surface and a rear plate, and said rear plate having means to prevent movement of said rear plate when said contact surface is impacted and moved by the batter during said batting stride.

7. The device of claim 6 wherein said contact surface is a front plate, said front plate including a substantially planar front surface facing the front foot of the batter, said front plate oriented in a vertical plane at both said beginning position and the ending position.

8. The device of claim 7 wherein said movement allowing means is a hinge interposed between said front plate and said rear plate, said hinge having a forward leaf fixedly attached to said front plate and a rearward leaf fixedly attached to said rear plate, said hinge oriented between a first end of said front plate and a first end of said rear plate and said spring oriented between a second end of the front plate and a second end of said rear plate.

9. The device of claim 6 wherein said movement preventing means includes a planar surface having sufficient size to support a batter thereon and means to attach said rear plate to said planar surface, whereby weight of the batter standing on said planar surface prevents said device from moving when said contact surface is impacted and moved by the batter.

10. The device of claim 6 wherein said movement preventing means includes a plurality of sleeves vertically attached to said rear plate and a plurality of spikes extending through said sleeves and into the ground.

11. A baseball batting training device comprising in combination:

a contact surface adapted to be impacted by a properly moved foot of a batter, as the batter's foot stride from a beginning position to an ending position means to allow movement of said contact surface from said beginning position to said ending position, means for resisting motion of said contact surface from said beginning position to said ending position operatively coupled to said contact surface, and for imparting motion to said contact surface from said ending position to said beginning position a rear plate coupled to said contact surface and having a lower edge, said rear plate oriented in a plane which extends substantially vertically upward from said lower edge, said rear plate including a plurality of sleeves attached thereto adapted to receive spikes passing through said sleeves and into an underlying support.

12. The device of claim 11 including a hinge attaching said rear plate to said contact surface, said hinge oriented to pivot about a vertical axis.

13. The device of claim 11 wherein said underlying support includes a planar surface having sufficient size to support a batter thereon and means to attach said rear plate to said planar surface, whereby weight of the batter standing on said planar surface prevents said rear plate from moving when said contact surface is impacted and moved by the batter.

* * * * *